United States Patent [19]

Means et al.

[11] Patent Number: 4,515,230

[45] Date of Patent: May 7, 1985

[54] ROOF DRILL BIT

[75] Inventors: Thomas C. Means, Versaille; Kenneth C. Emmerich, Lexington, both of Ky.

[73] Assignee: Fansteel Inc., North Chicago, Ill.

[21] Appl. No.: 642,886

[22] Filed: Aug. 21, 1984

Related U.S. Application Data

[63] Continuation of Ser. No. 436,582, Oct. 25, 1982, abandoned.

[51] Int. Cl.[3] ..... E21B 10/46

[52] U.S. Cl. ..... 175/410; 175/418

[58] Field of Search ..... 175/410, 417, 418, 419

[56] References Cited

U.S. PATENT DOCUMENTS 4,190,128 2/1980 Emmerich ..... 175/415 X 4,313,506 2/1982 O'Connell ..... 175/418 X 4,330,044 5/1982 Orr et al. ..... 175/410

*Primary Examiner*—Stephen J. Novosad

*Assistant Examiner*—Michael Starinsky

*Attorney, Agent, or Firm*—Barnes, Kisselle, Raisch, Choate, Whittemore & Hulbert

[57] ABSTRACT

A drill bit for use in mining, and in particular in rotative and percussion drilling action which includes a generally cylindrical body with a driving shank at one end and a transverse cutting insert at the other end. The body is hollow to conduct a suction force to the drilling area and side ports are formed in the body connected to the hollow center to draw in dust, chips and cuttings resulting from the drilling action. The shape and extent of the side ports is disclosed as $\frac{1}{4}$ to $\frac{1}{3}$ of the axial length of the body of the bit and circumferentially significantly increased with a shape which provides circumferential access to the ports as well as radial.

1 Claim, 14 Drawing Figures

FIG. 1
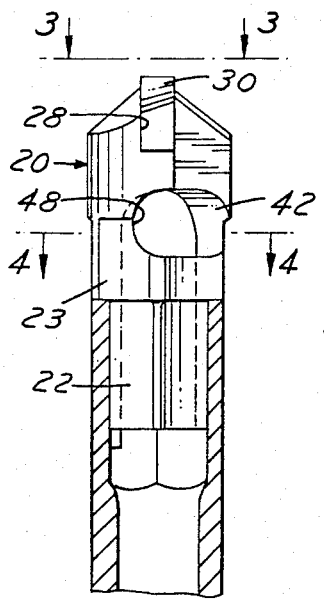
FIG. 2
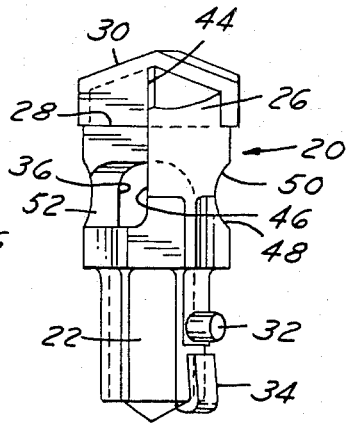
FIG. 3
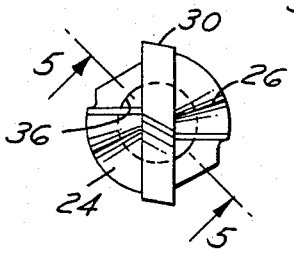
FIG. 5
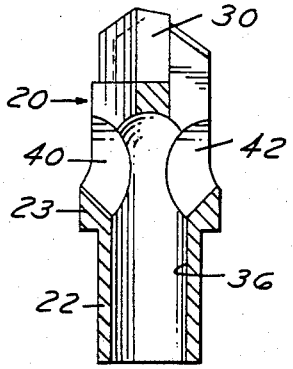
FIG. 4
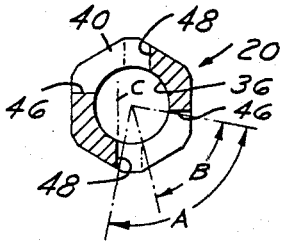
FIG. 6
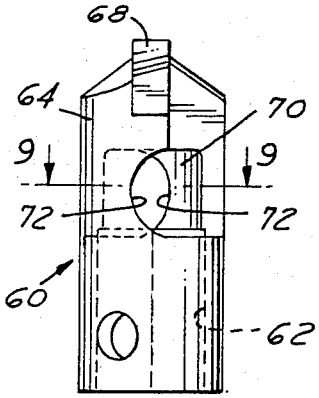
FIG. 7
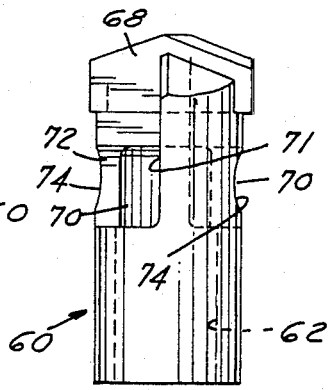
FIG. 8
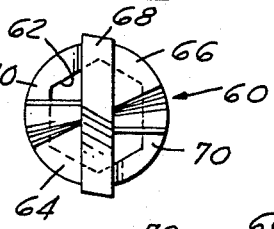
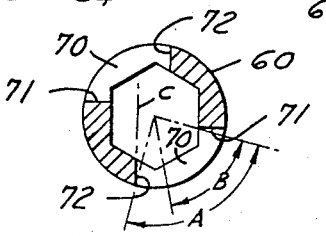
FIG. 9

ROOF DRILL BIT

This application is a continuation of our copending application, Ser. No. 436,582, filed Oct. 25, 1982, now abandoned, entitled "Roof Drill Bit".

FIELD OF INVENTION

Detachable roof drill bits driven by rotating drill steel elements and designed for drilling coal, rock, concrete, mineral ore and other hard substances.

BACKGROUND OF THE INVENTION

Roof drill bits having a round head with extending prongs in opposite quadrants of the bit are illustrated in a U.S. Pat. No. 4,165,790, to Emmerich, issued Aug. 28, 1979. The opposed prongs are in opposite sides of a diameter of the bit and support a cutting blade diametrically-positioned in recesses provided in the ends of the prong. A driving means on the head opposite the blade mechanically interfits with a drive steel rotated by a suitable power unit. In Emmerich U.S. Pat. No. 4,190,128 (Feb. 26, 1978), a similar type of bit is disclosed but the claimed improvement in this bit is a body with a polygonal configuration in cross-section which will blend with a similar configuration (usually hexagonal) on a driving steel. The driving surface on the bit can be a shank with an ensmalled male portion to interfit with a drill steel or a shank with a hexagonal female recess to interfit with a male hexagonal driving projection in a drill steel.

It is an object of the present invention to provide a drill steel design which greatly improves the drilling efficiency of the bit and provides a greater drilling speed in comparison with previous bits.

It will be appreciated that these bits are used with either a vacuum system or a pressure system through the passages in the bits and driving steels to assist in the removal of the cuttings and dust resulting from the drilling operation. The vacuum system is most common in many operations.

An example of a suction type bit is found in a patent issued to O'Connell, U.S. Pat. No. 4,313,506 (Feb. 2, 1982) where there is disclosed a round drill bit with a cross blade above suction openings leading into a driving shank having a central passage which receives a hollow drive steel having a driving engagement with a female recess in the bottom of the shank.

The present disclosure is directed to a bit similar to that shown in U.S. Pat. No. 4,190,128, above referenced, for use in a suction type system. The bit is preferably a polygonal outer surface which will register with a similar polygonal surface on a drive shank (drill steel) but the features of the present invention may also be incorporated in a bit having a round outer surface.

One essential feature of the bit of the present invention is an enlarged cutting hole in the wall of the bit. The hollow center of the bit is connected to the empty quadrants of the cutting end of the bit through holes in the wall of the bit which extend through a large angle of the circumference. At one instance the port extends essentially from a diameter of the bit to a chord which is perpendicular to the reference diameter and spaced to the other side of the center of the bit a distance substantially equal to the total width of the cutting insert at the end of the bit. The bit may be manufactured as a casting or as a forging, with some machining operations if required.

This construction has proven to be extremely effective in removing the cuttings and powder while increasing the drill rate materially.

Objects and features of the invention will be apparent in the following description and claims in which the invention is described together with details to enable those skilled in the art to practice the invention, all in connection with the best mode presently contemplated for the invention.

BRIEF DESCRIPTION OF THE DRAWINGS

Drawings accompany the disclosure and the various views thereof may be briefly described as:

FIG. 1, an elevation of a mining bit constructed in accordance with the present invention having a hexagonal body shank shown assembled on an external driving steel.

FIG. 2, a view of the bit turned 90° from the showing of the bit in FIG. 1.

FIG. 3, an end view of the bit on line 3—3 of FIG. 1.

FIG. 4, a transverse sectional view on line 4—4 of FIG. 1.

FIG. 5, a longitudinal sectional view on line 5—5 of FIG. 3.

FIG. 6, an elevation of a modified mining bit with an internal drive shank.

FIG. 7, a view of the bit turned 90° from the showing of FIG. 6.

FIG. 8, an end view of the bit.

FIG. 9, a sectional view on line 9—9 of FIG. 6.

DETAILED DESCRIPTION OF THE INVENTION AND THE MANNER AND PROCESS OF USING IT

Figure 10:
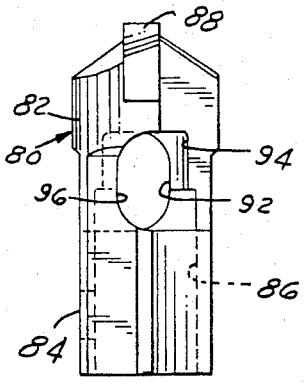
FIG. 10, an elevation of a second modification of a mining bit with an internal drive shank.
Figure 12:
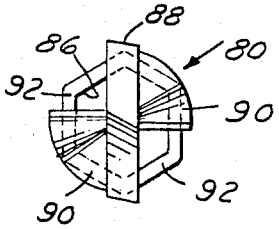
FIG. 12, an end view of the bit of FIG. 10.
Figure 11:
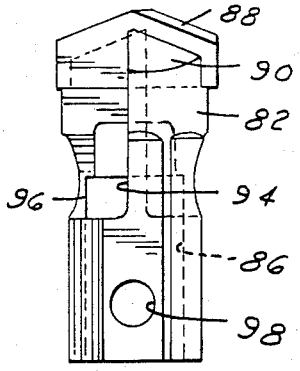
FIG. 11, a view turned 90° from the showing of the bit in FIG. 10.
Figure 13:
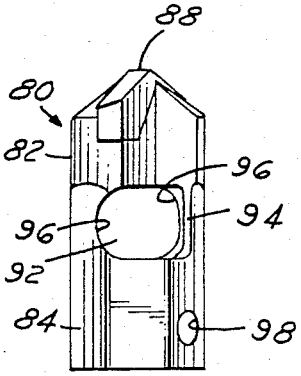
FIG. 13, a view of the bit turned so that the opposed side wall openings are aligned.

With reference to the drawings, in FIG. 1, a mining bit is shown. This is sometimes referred to as a roof drill bit since it is used in excavations to drill holes in the roof to receive reinforcing rods or cores. Drill rate is extremely important since the operation is expensive in terms of man-hours and roof drilling and reinforcement must precede other operations. Thus, any increase in drill rate is a definite gain. Two types of drilling systems are utilized. One involves pressurizing the interior of a hollow drill to force air and sometimes fluid out of the drill and this carries the drill chips and dust out around the drill and drill steels to the hole port. A second system involves creating a suction (subatmospheric pressure) in the drill and in the drill steels which drive the drill so that cuttings and dust are pulled through ports in the drill bit into the drill steel and out into a collector.

In FIG. 1, a drill body 20 is generally circular at the top and formed with a polygonal shape 23 at the lower part of the body, in this case, hexagonal. An external drive shank 22 is provided below the body 20. The body 20 has two prongs 24, 26 which project to the working end of the bit, each having a diametrical side slot 28 in which is located one end of a hard metal cutting insert 30 brazed in place. The prongs 24, 26 are disposed in opposite quadrants on either side of a diameter of the drill, and the other quadrants are open down to the base of the bit well into the hexagonal portion 23. In FIG. 2, a retaining button 32 is shown mounted on a resilient loop 34 for retaining the bit in the drive shank. The end view in FIG. 3 shows the support prongs 24, 26 and the diametrically positioned insert 30.

Figure 14:
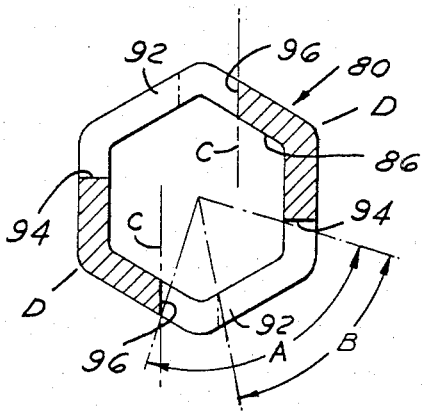
FIG. 14, an enlarged sectional view on line 14—14 of FIG. 10.

The bit body has a central passage 36. Side ports are cut into the central passage as shown at 40, 42 in FIG. 5. These ports have an axial length along the axis of roation of about one-fourth to one-third the length of the exposed bit when drilling. The circumferential extent of these ports according to the present invention is defined in terms of the angle A as shown in FIGS. 4, 9 and 14. The angle A is generally about 75° plus the width of the insert 30. In terms of angles, this amounts to a total angular span of about 88° to 90°. In FIG. 14, which is an enlarged section, the angle A includes 75° plus an extension angle which is about 13° to 15°. The origin of the angle A is close to a common diameter, as shown in FIGS. 4, 9 and 14, and the terminus is at a chord C as shown in FIG. 14. Thus, about 180° of the full 360° is occupied by the ports. Previous commercial bits have had a circumferential extent of 61° to 64° as shown at B in FIGS. 4, 9 and 14.

The configuration of the side ports has significance in the success of the operation. As shown in FIGS. 1 and 2, one end of the opening 42 is a relatively straight axial fall from the crest 44 as shown at 46. The other end of port 42 is curved as shown at 48 by cutting the port back into the residual web or wall between the ports. When viewed as in FIG. 2, this presents curved identations into the bit body at 50 in port 42 and 52 in port 40. Thus, the ports are open at these curved ends to allow air, dust, chips, and cuttings to reach the ports circumferentially as well as radially. These curved openings at the respective ends of the ports are on the trailing end of the ports but they can pull in dust not picked up by the leading port and thus prevent impaction on and around the drill bit.

In FIGS. 6 to 9, a modification of the bit is shown with a cylindrical body 60 and a drive shank with an internal drive recess and central passage 62. The two prongs 64, 66 support the diametrical insert 68 while the vacant quadrants open to the interior passage 62 through the side wall ports 70 starting at 71 and ending at 72. The axial and circumferential extent of the ports is as described in connection with FIGS. 4, 9 and 14. The curved depressions in the side wall are shown at 74 in FIG. 7.

In FIGS. 10 to 14, a second modification is illustrated. A body 80 has a generally cylindrical top portion 82 above a polygonal, in this instance, hexagonal, body portion 84. A central polygonal passage 86 provides an internal drive shank. A cutting insert 88 is supported in extending quadrants 90 and the opposite quadrants are open to the side ports 92 which originate at 94 and terminate in the curved end 96. A hole 98 can receive a retention device, such as the retainer 32, 34 shown in FIG. 2.

In FIG. 14, the circumferential extent of the ports 92 is illustrated as originating close to a common diameter at 94 and terminating at 96 at a chord C which is perpendicular to the said reference diameter and spaced away from the center axis. The total angular extent of angle A is generally about 88°.

It will be appreciated that when a port is opened circumferentially to the extent defined with a curved indentation at one end, the wall of the bit forms the radial indentation which allows the ports to receive and collect particles circumferentially as well as longitudinally and radially. This also opens the air access which provides for a greater volume of flow. The port is preferably milled in or shaped to provide the curved indentation as above indicated at the end of the port to open the wall to a greater degree as illustrated at 48 in FIG. 1 and 72 in FIG. 6.

The enlarged ports provide circumferential and radial ingress for cuttings, chips and dust, especially in the suction system and a much faster drilling rate is obtainable with these enlarged ports and radial clearance openings.

The metal remaining between the large dust ports preferably includes a polygonal corner such as the hexagonal corner shown at D in FIG. 14. This strengthens this portion of the bit for the torsional and compressive forces to which it is subjected in use. The bit is rotated and also may be reciprocated in contact with the material to be drilled, and thus is subject to rotation and percussion forces.

What is claimed as new is:

1. A mining drill bit for rotary and percussion drilling of hard materials such as rock, coal, concrete and the like which includes a generally cylindrical metal body with an axis of rotation and having an acircular driving surface axially disposed on a driving end of the body and a central cooling passage within said body, support prongs extending axially from a working end on said body in diametrically opposed quadrants with aligned ledge surfaces to support the bottom of a cutting insert and axially extending spaced parallel surfaces in contact with the trailing sides of said insert on opposite sides of the center of said body, the remaining quadrants being formed to provide chip slash openings extending toward the driving end of said body to form ports connecting to the central cooling passage of the body, that improvement in which said support prongs have flat axially extending surfaces substantially at right angles to each other extending axially from the working end of the body to form side edges of a wall port opening between the working end and the driving end into the central cooling passage, one of said support prongs on the trailing side of each said port being cut away radially to form an arcuate, semicircular entrance at one side of a wall port underlying the respective outer ends of the cutting insert to substantially increase the circumferential extent of said wall ports to 180°.

* * * * *